US007100523B2

(12) United States Patent
Terao

(10) Patent No.: US 7,100,523 B2
(45) Date of Patent: Sep. 5, 2006

(54) EMBROIDERY FRAME FOR CAPS

(75) Inventor: Akira Terao, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/134,277

(22) Filed: May 23, 2005

(65) Prior Publication Data

US 2005/0263055 A1 Dec. 1, 2005

(30) Foreign Application Priority Data

May 28, 2004 (JP) ..... 2004-159731

(51) Int. Cl.
*D05C 9/04* (2006.01)
*D05B 21/00* (2006.01)

(52) U.S. Cl. ..... 112/103; 38/102.2

(58) Field of Classification Search ..... 112/103, 112/102, 119, 470.06, 470.14, 475.11, 475.18; 38/102.2, 102.91
See application file for complete search history.

(56) References Cited

U.S. PATENT DOCUMENTS 4,763,587 A * 8/1988 Frye ..... 112/470.06
4,831,753 A * 5/1989 Inteso ..... 38/102.3
6,189,468 B1 * 2/2001 French ..... 112/103
6,227,129 B1 * 5/2001 Parker, Jr. ..... 112/475.18
6,394,012 B1 * 5/2002 French et al. ..... 112/103
6,463,867 B1 * 10/2002 Kato ..... 112/103
6,708,632 B1 * 3/2004 Shibata ..... 112/103

FOREIGN PATENT DOCUMENTS

JP A 11-200228 7/1999
JP A 2000-334190 12/2000

* cited by examiner

*Primary Examiner*—Ismael Izaguirre
(74) *Attorney, Agent, or Firm*—Oliff & Berridge, PLC

(57) ABSTRACT

An embroidery frame for a cap includes a cap support having a pair of side walls capable of being disposed at both sides of a cylinder bed so that the side walls are parallel to a direction of extension of the cylinder bed, a pair of body supports mounted on the upper ends of the respective side walls for supporting a cap, body, the side walls including a pair of visor supports mounted on upper ends of the proximal ends of the side walls, respectively. The visor supports receive a visor of the cap from below at a position located higher than the body supports, and a pair of visor escapes on the side walls for escaping the visor of the cap, respectively. A cap pressing frame mounted to be contacting with and departing from the cap support.

14 Claims, 11 Drawing Sheets

EMBROIDERY FRAME FOR CAPS

BACKGROUND OF THE INVENTION

1. Field of the Invention

This invention relates to an embroidery frame for caps capable of sewing embroidery on a visored cap.

2. Description of the Related Art

Various types of embroidery sewing machines have conventionally been proposed and practiced in which an embroidery frame for caps is attached thereto so that various types of embroidery patterns are sewn on an embroidery part of a cap supported by the embroidery frame. For example, JP-A-H11-200228 discloses a cap frame device provided with a rectangular cloth carriage frame moved in X and Y directions on a work table. X-direction and Y-direction driving mechanisms are provided for moving the cloth carriage frame in the X and Y directions respectively. Further, a sewing machine body frame includes a sewing bed body to which a rear end of a support shaft is secured. A base frame of the cap frame device is supported on the support shaft. The base frame is moved via a link mechanism back and forth (in the Y direction) with the cloth carriage frame. A rotating frame for attaching the cap frame is rotatably mounted on the base frame. The rotating frame is rotated in synchronization with the right-and-left movement of the cloth carriage frame by a wire wound thereon.

Furthermore, JP-A-2000-334190 discloses an embroidery frame for caps including a flat plate-shaped frame body with a visor presser and a presser frame pivotally mounted on the frame body. A visor of a cap is inserted between the frame body and the visor presser. The cap body other than the visor is spread so that the embroidery sewing part becomes as planar as possible. The cap body is then pressed by the presser frame, and the inside of the cap is affixed to the underside of the frame body by a seal interlining.

SUMMARY OF THE INVENTION

The inventor considers that the above-described related art has the following problem. In the cap frame device disclosed in the above-noted JP-A-H11-200228, the rotating frame is driven by the wire. Accordingly, the rotating frame needs to be made of a metal so as to have a predetermined rigidity. Furthermore, a large drive motor is necessitated since a driving load and inertia are increased when the rotating frame is rotated simultaneously with the cap frame attached to the rotating frame. As a result, the cost of the embroidery sewing machine is increased and a large space is necessary to accommodate the large drive motor. Particularly, since household embroidery sewing machines are required to be purchased at a low cost and to be small in size, the cap frame device of the above-described type is unsuitable for the use with the household embroidery sewing machines.

Furthermore, in the embroidery frame for caps disclosed in JP-A-2000-334190, a flat frame is employed as the cap frame and is moved in the X and Y directions perpendicular to each other. This construction necessitates no large rotating frame and no large cap frame to be set on the rotating frame. Accordingly, the disclosed cap frame can contribute to cost reduction and downsizing so as to be usable with the household embroidery sewing machines. However, a cap is attached to the cap frame while a visor and embroidery part of the cap are stretched outward. In particular, stretching the embroidery part into a planar shape is a complicated work. Moreover, an interlining needs to be finally affixed. Thus, attaching the cap to the cap frame necessitates a lot of working time and labor, resulting in reduction in the working efficiency.

Therefore, an object of the present invention is to provide an embroidery frame for caps which is low-cost and small in size and can improve the working efficiency in attaching a cap to the frame.

In order to achieve the object, the present invention provides an embroidery frame for a cap having a proximal end side provided with a pair of driving connectors detachably connected to a driver of an embroidery frame driving mechanism of a sewing machine including a cylinder bed. The embroidery frame comprises a cap support having a pair of side walls capable of being disposed at both sides of the cylinder bed so that the side wall are parallel to a direction of extension of the cylinder bed, each side wall having an upper end, a proximal end and a predetermined height and body supports provided on the upper ends of the respective side walls for supporting a cap body of a cap on which embroidery is to be sewn, the body supports forming a sewing opening defining an embroidable region. The side walls includes visor supports provided on upper ends of the proximal ends of the side walls respectively, the visor supports receiving a visor of the cap from below at a position located higher by a predetermined height than the body supports and visor escapes provided on the side walls for escaping the visor of the cap respectively, the visor escapes being formed by cutting off the upper ends of the side walls respectively. The embroidery frame further includes a cap pressing frame provided so as to be brought into contact with and depart from the cap support, the cap pressing frame pressing, against the body support, the cap attached to the cap support so as to be fitted with the cap support.

The cap support has a pair of side walls, visor supports and visor escapes. Accordingly, when a cap, which has a visor, is held on the embroidery frame for a cap so that embroidery can be formed on the cap, the visor is received by the visor supports at a position higher than the body supports. Moreover, the visor is escaped by the visor escapes formed by cutting off the upper ends of the side walls respectively. Thus, since the visor can be inclined and held three-dimensionally, the embroidery-forming part of the cap body can easily be rendered flat and stretched on the body supports.

Furthermore, the height of each body support is increased by the height of the side wall. Accordingly, the user can powerfully pull portions of the cap body around the respective body supports with both hands so that the embroidery-forming part is stretched flat. As a result, the working efficiency can be improved in stretching the cap body. Further, since the embroidery frame has only the cap support and cap pressing frame, the size and weight of the embroidery frame can be reduced, and accordingly, the cost of the embroidery frame can also be reduced.

The invention also provides an embroidery frame for a cap for holding the cap to be embroidered so that embroidery is allowed to be sewn on the cap. The embroidery frame is attached to a sewing machine in use. The sewing machine includes a cylinder bed. An embroidery frame driving mechanism includes a driver and a sewing mechanism. The embroidery frame comprises a cap support including a body support supporting a body of the cap, the body support forming a sewing opening defining a plane embroidable region parallel to an upper surface of the cylinder bed, the cap support having a proximal end. The embroidery frame further comprises a pair of driving connectors provided at the proximal end side of the cap support and detachably connected to the driver of the embroidery frame driving mechanism of the sewing machine, the driving connectors being spaced away from each other so that a space larger than a width of the cylinder bed with respect to a horizontal direction, the driving connectors being formed so as to extend by a predetermined length in such a direction that the driving connectors depart from the sewing opening, the driving connectors defining an attachment opening therebetween so that the attachment opening allows a visor of the cap to detour the sewing mechanism when the driving connectors are attached to the driver of the embroidery frame driving mechanism.

The driving connectors are each formed so as to extend by a predetermined length in such a direction that the driving connectors depart from the sewing opening. Further, an attachment opening is defined between the driving connectors so that the attachment opening allows the visor of the cap held on the embroidery frame to escape from the sewing mechanism when the driving connectors are attached to the driver of the embroidery frame driving mechanism. Accordingly, when the embroidery frame holding the cap is attached to the sewing machine, the driving connectors extending to the proximal end side of the embroidery frame are disposed at both sides of the cylinder bed respectively. In this state, the embroidery frame can easily be caused to escape so that the visor is allowed to pass through gaps defined by a sewing needle and presser foot, while being swung vertically without being rotated right-and-left. Consequently, the driving connectors can easily be connected to the driver of the embroidery frame driving mechanism.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
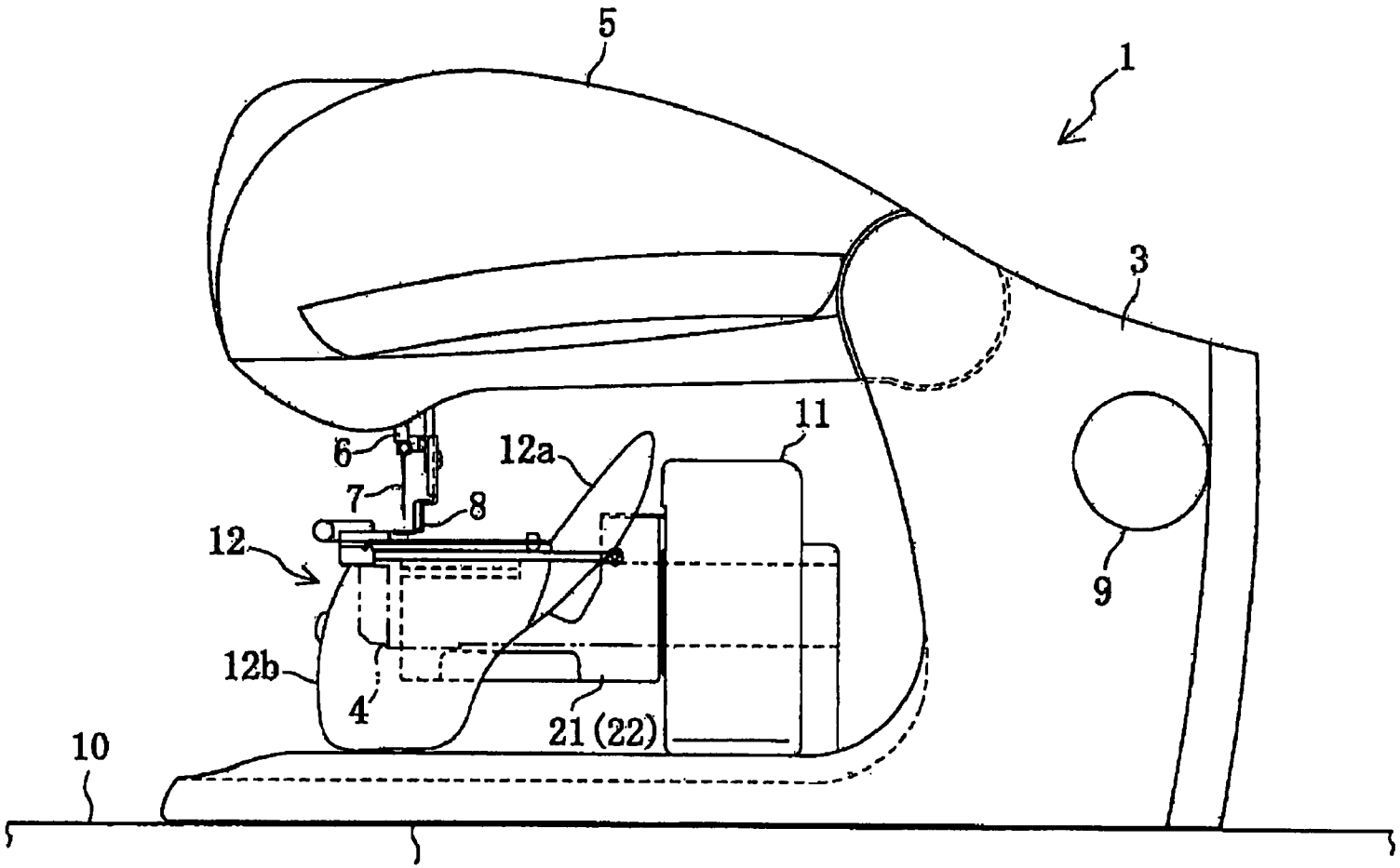
FIG. 1 is a side view of an embroidery sewing machine to which an embroidery frame for caps in accordance with one embodiment of the present invention is attached.

One embodiment of the present invention will be described with reference to the accompanying drawings. Referring to FIG. 1, an embroidery sewing machine 1 is shown as accompanied by an embroidery frame for caps in accordance with one embodiment. The embroidery sewing machine 1 includes a horizontal base 2 mounted on a work table 10 or the like, a pillar 3 standing from a rear end of the base 2, a cylinder bed 4 horizontally extending frontward from the pillar 3 and a sewing arm 5 extending frontward from an upper end of the pillar 3. The cylinder bed 4 extends back and forth. The front of the cylinder bed 4 constitutes a distal end whereas the rear thereof constitutes a proximal end.

The arm 5 is provided with a main shaft driven by a sewing machine motor, a needle bar driving mechanism vertically moving a sewing needle via a needle bar 6, a bobbin driving mechanism and a presser foot driving mechanism vertically moving a presser foot 8 none of which are shown. In the cylinder bed 4 are provided a loop taker forming stitches in cooperation with a sewing needle 7, a thread cutting mechanism cutting an upper or needle thread and a lower or bobbin thread and the like none of which are shown. A hand pulley 9 is mounted on the pillar 3 so as to be manually operated by an operator so that the main shaft is rotated to move the needle 7 up and down.

An embroidery frame 15 for caps will now be described. The embroidery frame 15 can hold a cap 12 with a visor to be embroidered in a state where embroidery can be formed on the cap 12. The embroidery frame 15 is adapted to be attached to a driver 11 of an embroidery frame driving mechanism. In the embodiment, the cap 12 includes a visor 12*a* and a cap body 12*b*. The embroidery frame 15 includes a pair of driving connectors 16 which are connected to the driver 11 so that the embroidery frame 15 is moved back and forth, and right and left in the same manner as a flat frame.

Figure 2:
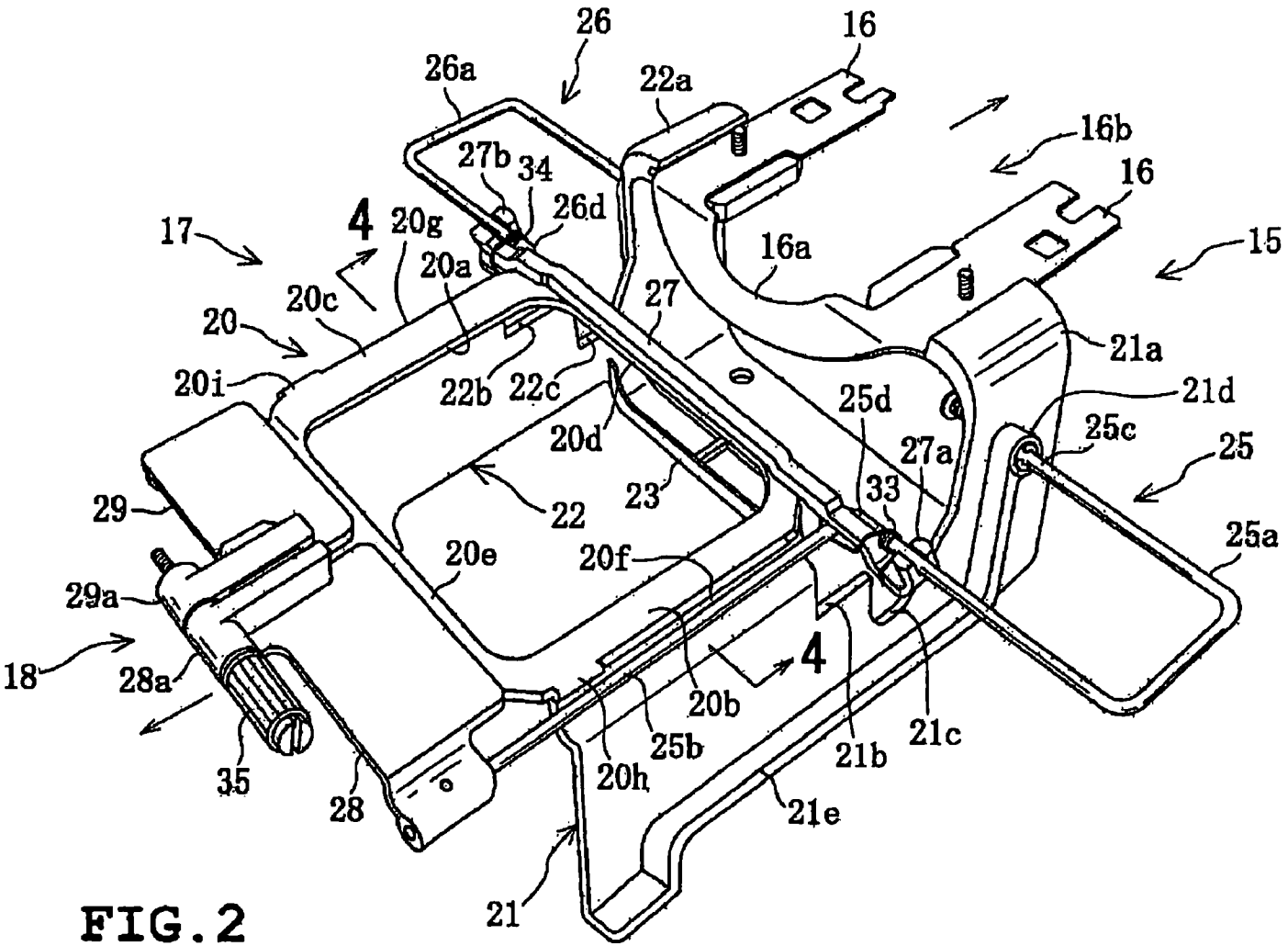
FIG. 2 is a perspective view of the embroidery frame.
Figure 3:
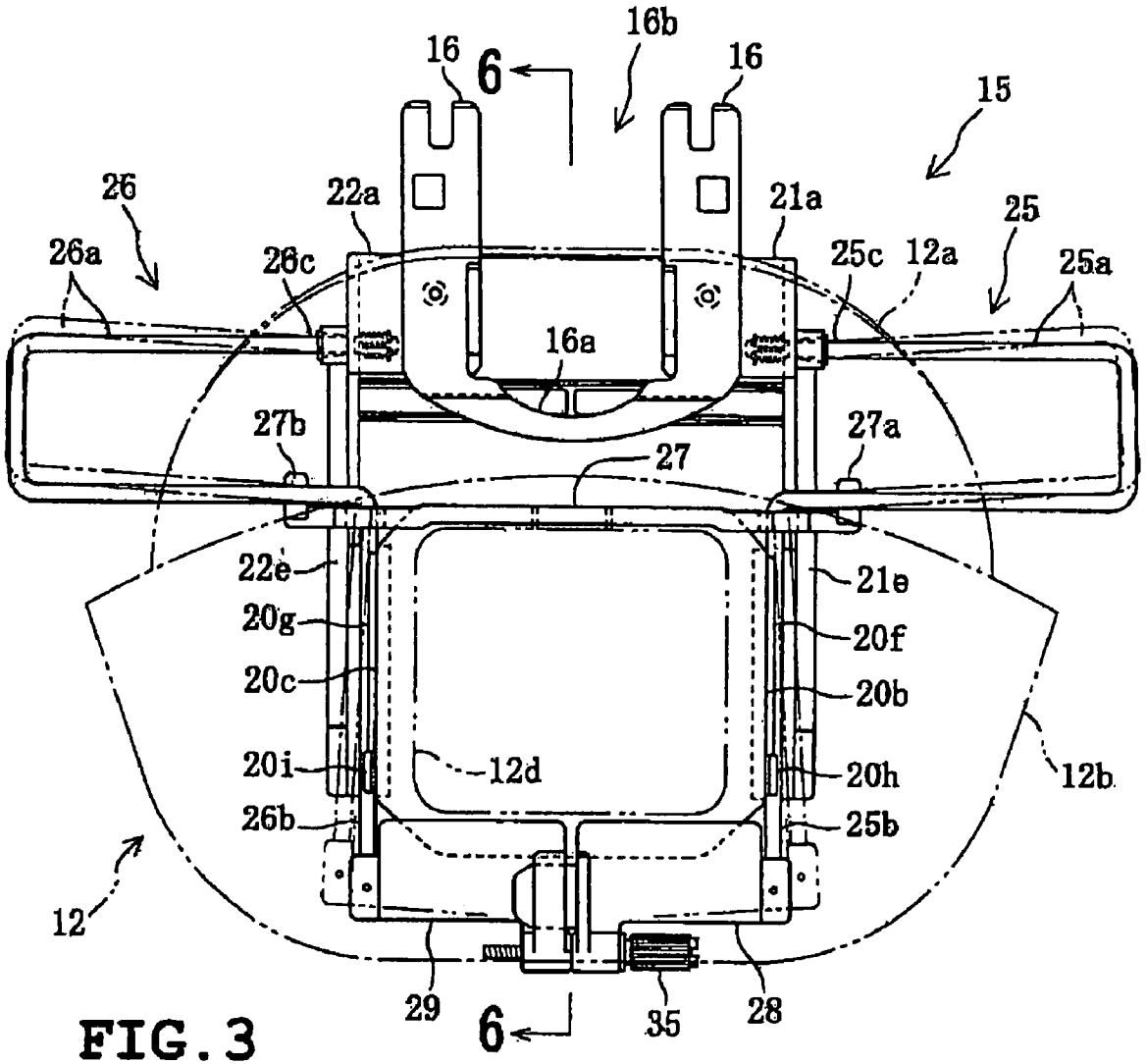
FIG. 3 is a plan view of the embroidery frame.
Figure 5:
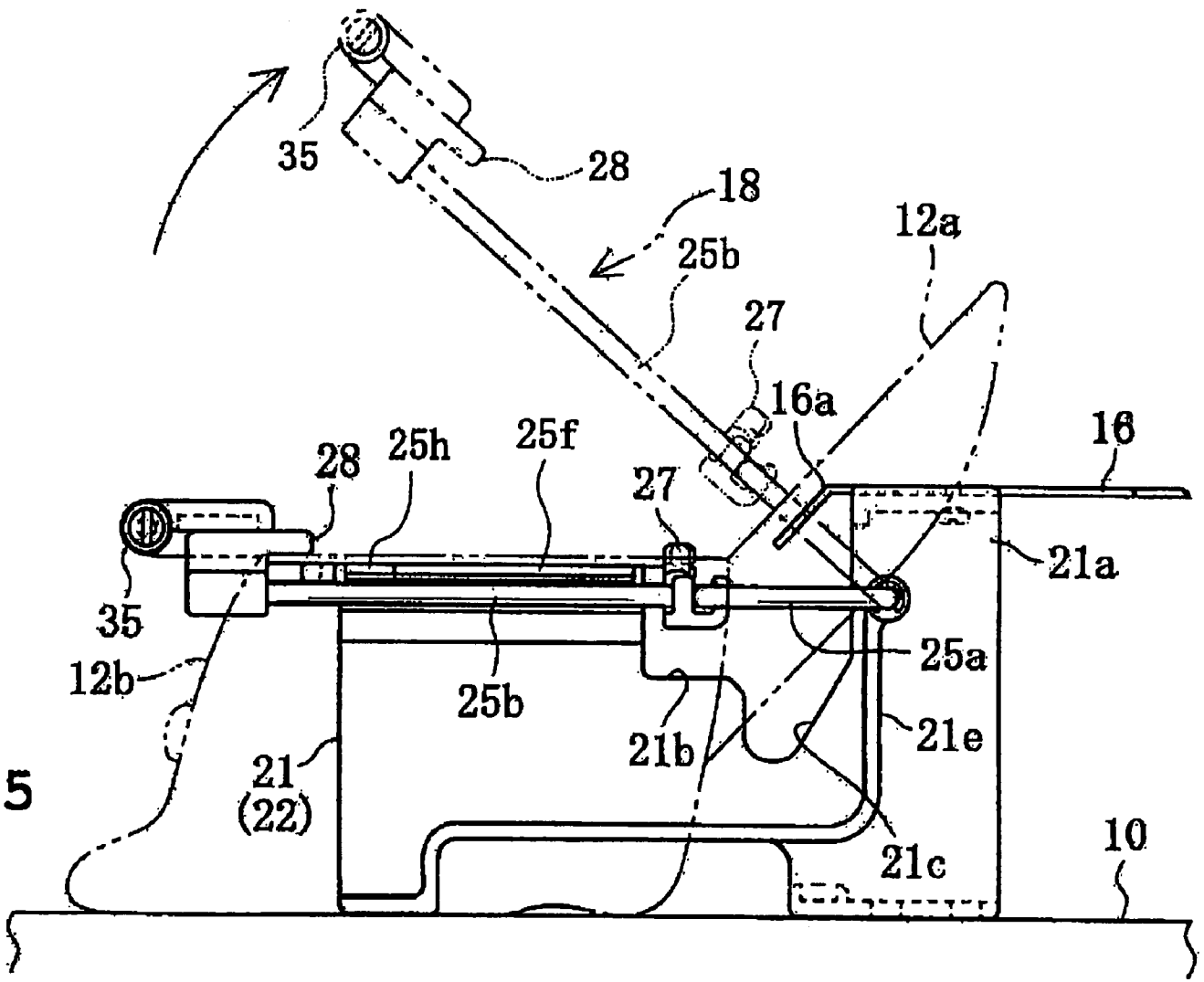
FIG. 5 is a side view of the embroidery frame.
Figure 6:
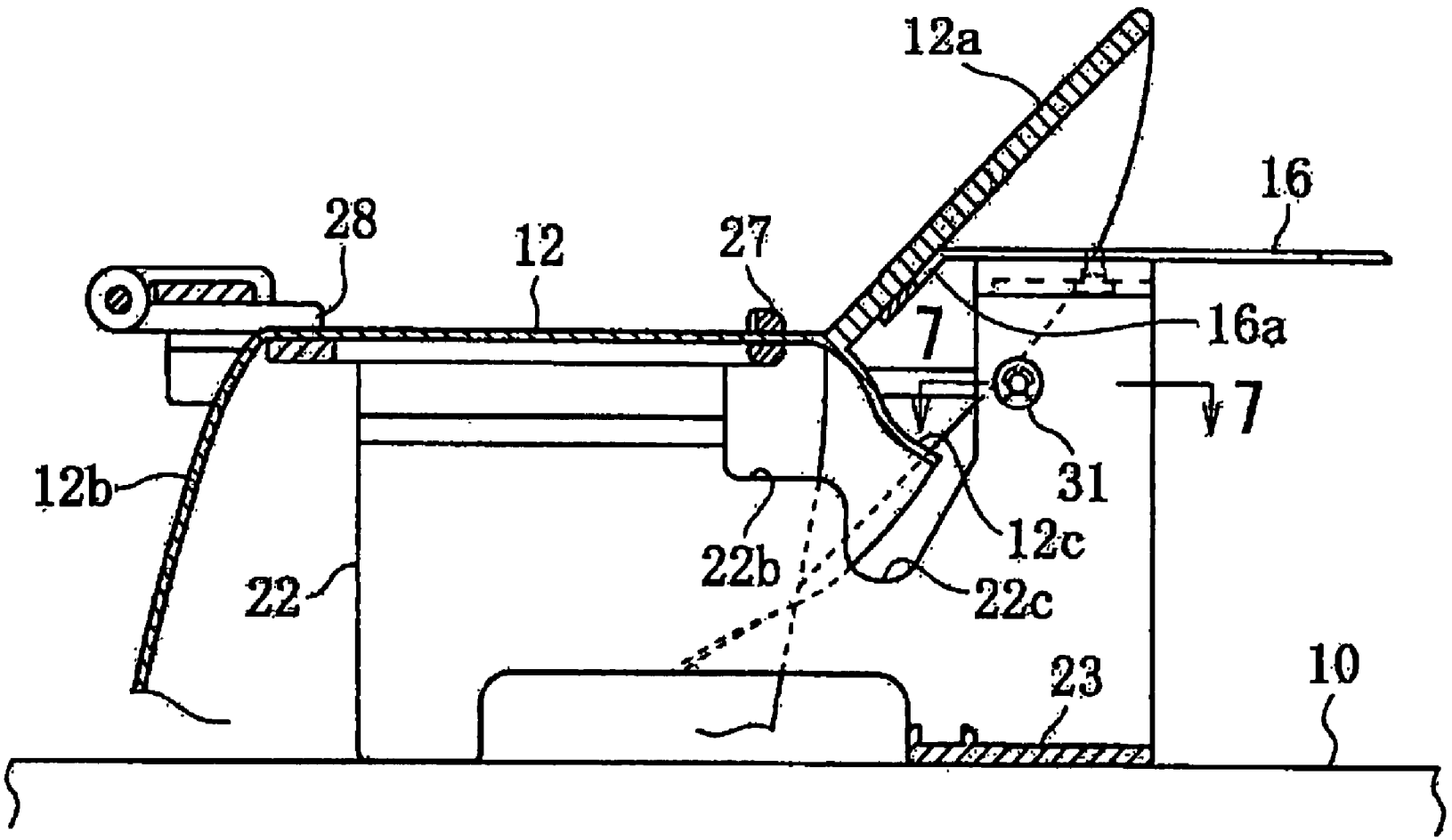
FIG. 6 is a longitudinally side view taken along line 6—6 in FIG. 3.

Referring to FIGS. 2, 3 and 5, the embroidery frame 15 has proximal ends on which the driving connectors 16 are made from a metal. The embroidery frame 15 further includes a cap support 17 made from a synthetic resin and a cap pressing frame 18 fitted with the cap support 17 so as to come into contact with and depart from the cap support so that the cap pressing frame 18 presses the cap 12 outside.

The cap support 17 will now be described. The cap support 17 includes a pair of left and right side walls 21 and 22 each of which is made from a resin and has a predetermined height. The cap support 17 further includes a body support 20 formed integrally with the side walls 21 and 22 and supporting the cap body 12*b*. The body support 20 includes a pair of longitudinal supports 20*b* and 20*c* which are parallel with the side walls 21 and 22 and are formed on upper ends of the side walls 21 and 22 respectively. The body support 20 further includes a pair of transverse supports 20*d* and 20*e* perpendicular to the longitudinal supports 20*b* and 20*c* respectively. A substantially square or otherwise rectangular sewing opening 20*a* is defined in the central cap support 17 by the longitudinal supports 20*b* and 20*c* and transverse supports 20*d* and 20*e*. The sewing opening 20*a* serves as a planar sewable region.

A pair of engagement protruding bars 20*f* and 20*g* are mounted on the longitudinal supports 20*b* and 20*c* so as to protrude from the outer undersides of the supports and so as to extend back and forth, respectively. A cap pressing frame 18 engages the engagement protruding bars 20*f* and 20*g* with the cap body 12*b* being held therebetween. The engagement protruding bars 20*f* and 20*g* have rear ends formed with protrusions 20*h* and 20*i* engaging engagement frames 25*b* and 26*b* of the cap pressing frame 18 from above, respectively, as will be described later.

The proximal ends of the side walls 21 and 22 have lower ends connected to each other by a connecting member 23. The side walls 21 and 22 are disposed at both sides of the cylinder bed 4 so as to be directed back and forth (so as to be parallel to the direction of extension of the cylinder bed 4) respectively when the embroidery frame 15 is attached to the sewing machine.

The proximal ends of the side walls 21 and 22 have upper ends formed with visor supports 21*a* and 22*a* receiving and supporting the visor 12*a* of the cap 12 at a position located higher by a predetermined height than the body support 20. The upper ends of the proximal ends of the side walls 21 and 22 further have a pair of visor escapes 21*b* and 22*b* formed by cutting off the upper ends of the side walls respectively so as to cause the visor 12*a* to escape. The upper ends of the proximal ends of the side walls 21 and 22 still further have perspiration inducer engagement portions 21*c* and 22*c* formed in a stepped shape in the visor escape portions 21*b* and 22*b* so as to engage a perspiration inducer 12*c* of the cap 12 respectively.

More specifically, the paired driving connectors 16 are secured to the proximal end of the cap support 17 and extend in parallel to each other with a space defined therebetween. The space is slightly larger than a width of the cylinder bed 4. The driving connectors 16 have front ends connected to each other by a generally U-shaped visor support 16*a* formed integrally therewith. The visor support 16*a* includes a front inclined downward so that the middle part of the visor 12*a* can be supported in an inclined state from below when the cap 12 is attached to the embroidery frame, as shown in FIGS. 2 and 5. Accordingly, an attachment opening 16*b* having a predetermined length and width is defined between the driving connectors 16.

Figure 7:
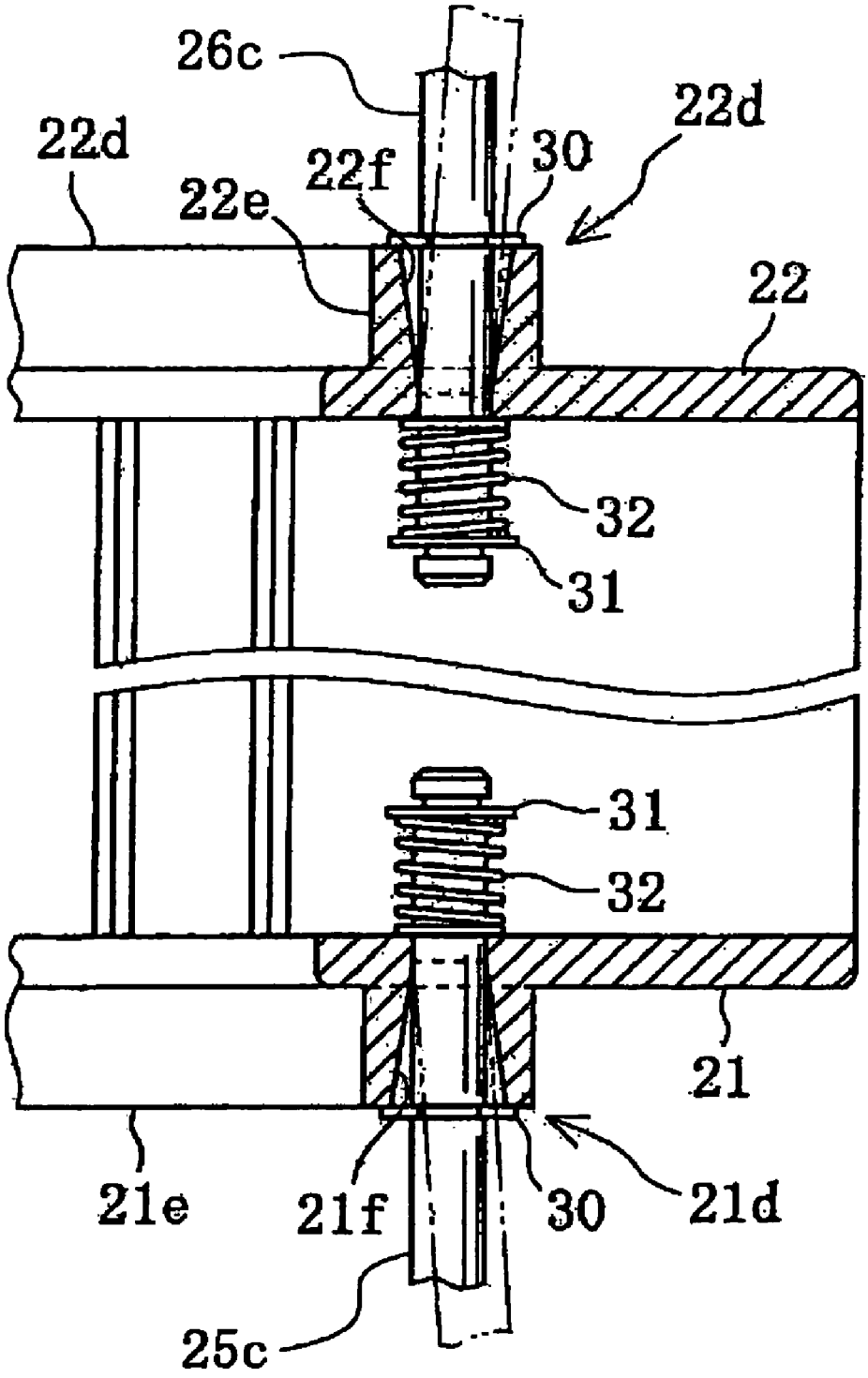
FIG. 7 is a transversely sectional plan view taken along line 7—7 in FIG. 6.

The cap pressing frame 18 will be described with reference to FIGS. 2 to 5. The cap pressing frame 18 includes a pair of left and right holding levers 25 and 26 made of a metal pipe. The cap pressing frame 18 further includes a pressing member 27 mounted between the holding levers 25 and 26 and a pair of left and right split pressing members 28 and 29 connected to front portions of the holding levers 25 and 26. The holding levers 25 and 26 include rear portions serving as detouring portions 25*a* and 26*a* formed integrally therewith. The detouring portions 25*a* and 26*a* are bent in a back-and-forth direction substantially into a U-shape relative to the holding levers 25 and 26, thereby being configured so as to detour the visor 12*a* of the cap 12 outward. A pair of linear engagement frames 25*b* and 26*b* are formed integrally with the detouring portions 25*a* and 26*a* respectively as shown in FIG. 3. The engagement frames 25*b* and 26*b* are continuous to the front portions of the detouring portions 25*a* and 26*a* respectively. The holding levers 25 and 26 have proximal ends formed with pivot shafts 25*c* and 26*c* respectively as shown in FIG. 7. The pivot shafts 25*c* and 26*c* are pivotally supported on pivotally supporting portions 21*d* and 22*d* formed in the rear ends of the side walls 21 and 22 so as to pivot about axes perpendicular to the side walls 21 and 22 respectively.

Reinforcing ribs 21*e* and 22*e* are formed on outer lower ends of the side walls 21 and 22 respectively as shown in FIGS. 2 and 7. Each of the reinforcing ribs 21*e* and 22*e* has a predetermined width and extends from the rear to the front of the corresponding side wall. More specifically, each of the reinforcing ribs 21*e* and 22*e* is formed into a generally L-shape in a side view. The pivotally supporting portions 21*d* and 22*d* have tapered bearing holes 21*f* and 22*f* having diameters gradually increased as the bearing holes go outward, respectively. The pivot shafts 25*c* and 26*c* of the holding levers 25 and 26 are inserted through the tapered bearing holes 21*f* and 22*f* respectively. Locking rings 30 and 31 are secured to the ends and portions of the pivot shafts 25*c* and 26*c* immediately outside the bearing holes 21*f* and 22*f* respectively. Compression coil springs 32 serving as biasing members are provided between the side walls 21 and 22 and the end side locking rings 31 respectively, so that the pivot shafts 25*a* and 26*c* are elastically biased toward widthwise (right-and-left direction) central side with respect to the embroidery frame 15.

Figure 4:
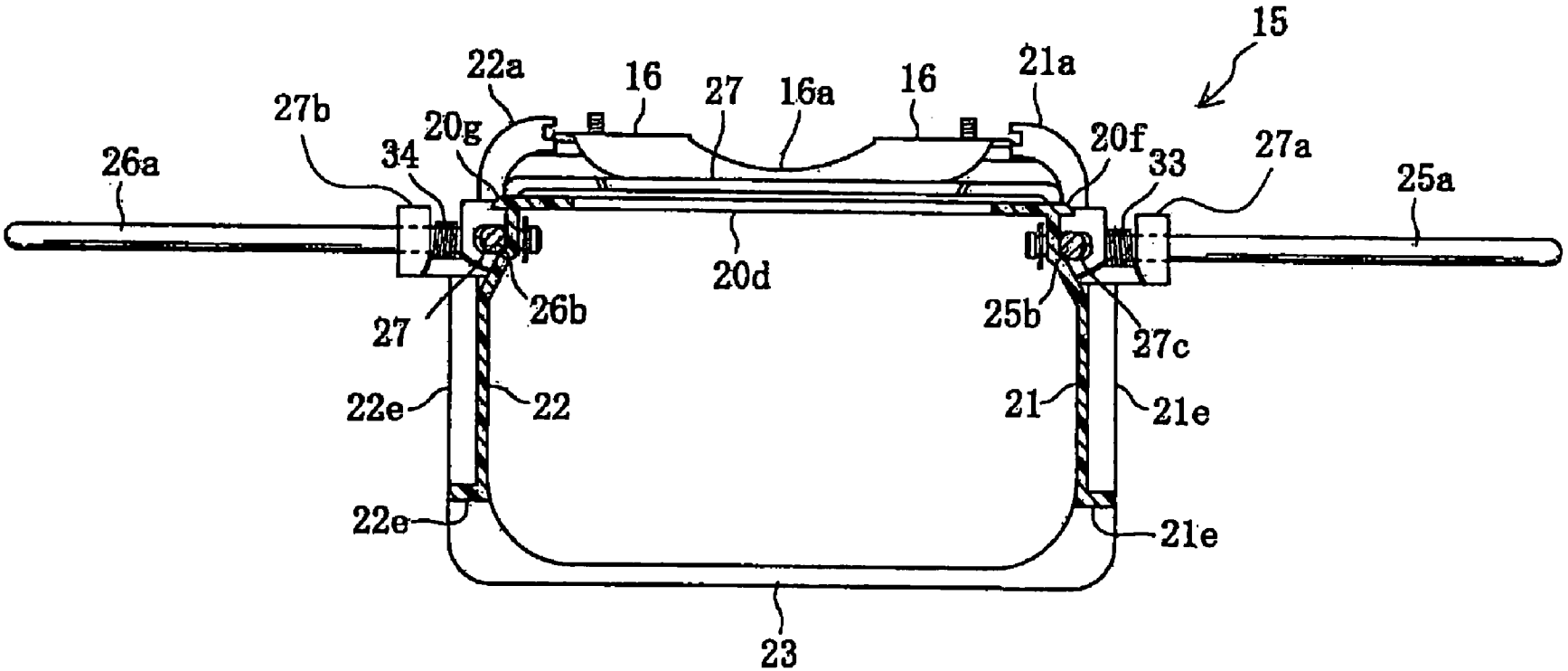
FIG. 4 is a longitudinally front view taken along line 4—4 in FIG. 2.

Connections 25*d* and 26*d* are formed between the detouring portions 25*a* and 26*a* and engagement frames 25*b* and 26*b* by bending the corresponding portions at a right angle respectively. A pressing member 27 is mounted between the connections 25*d* and 26*d* so as to extend right and left. The pressing member 27 has both ends formed with upwardly open bifurcated portions 27*a* and 27*b*. The pressing member 27 further has elongate recesses 27*c* and 27*d* formed so as to be located nearer to the widthwise center of the pressing member 27 than the bifurcated portions 27*a* and 27*b* respectively, as shown in FIG. 4. The engagement frames 25*b* and 26*b* are fitted in the elongate recesses 27*c* and 27*d* as shown in FIG. 4 and portions of the detouring portions 25*a* and 26*a* located nearer to the connections 25*d* and 26*d* are fitted in the bifurcated portions 27*a* and 27*b* from above respectively as shown in FIG. 3.

Torsion coil springs 33 and 34 are wound on portions of the detouring portions 25*a* and 26*a* located near the connections 25*d* and 26*d* respectively as shown in FIG. 2. The torsion coil springs 33 and 34 have one ends engaging the engagement frames 25*b* and 26*b* from below respectively. The other ends of the torsion coil springs 33 and 34 are engaged with portions of the pressing member 27 near the bifurcated portions 27*a* and 27*b* from the front respectively. Consequently, the pressing member 27 is biased by the biasing force of torsion coil springs 33 and 34 so as to be pressed against the rear transverse support 20*d* from above when the cap body 12*b* is attached to the embroidery frame 15.

The holding levers 25 and 26 have distal ends formed with split pressing members 28 and 29 pressing the cap body 12*b* against the front side transverse support 20*e* which is the distal end side, respectively. The split pressing members 28 and 29 have distal ends formed with fastening portions 28*a* and 29*a* capable of fastening opposite ends of the split pressing members 28 and 29 respectively. A nut (not shown) is secured in the left fastening portions 29*a*. A set screw 35 having a long threaded portion is inserted through the right fastening 28*a* into threading engagement with the nut, whereby the fastening portions 28*a* and 29*a* are fastened. As a result, the engagement frames 25*b* and 26*b* are pressed against the undersides of the engagement protruding bars 20*f* and 20*g* of the longitudinal supports 20*b* and 20*c* by the fastening portions 28*a* and 29*a* and split pressing members 2B and 29 from outside respectively, thereby being held in position.

Figure 11:
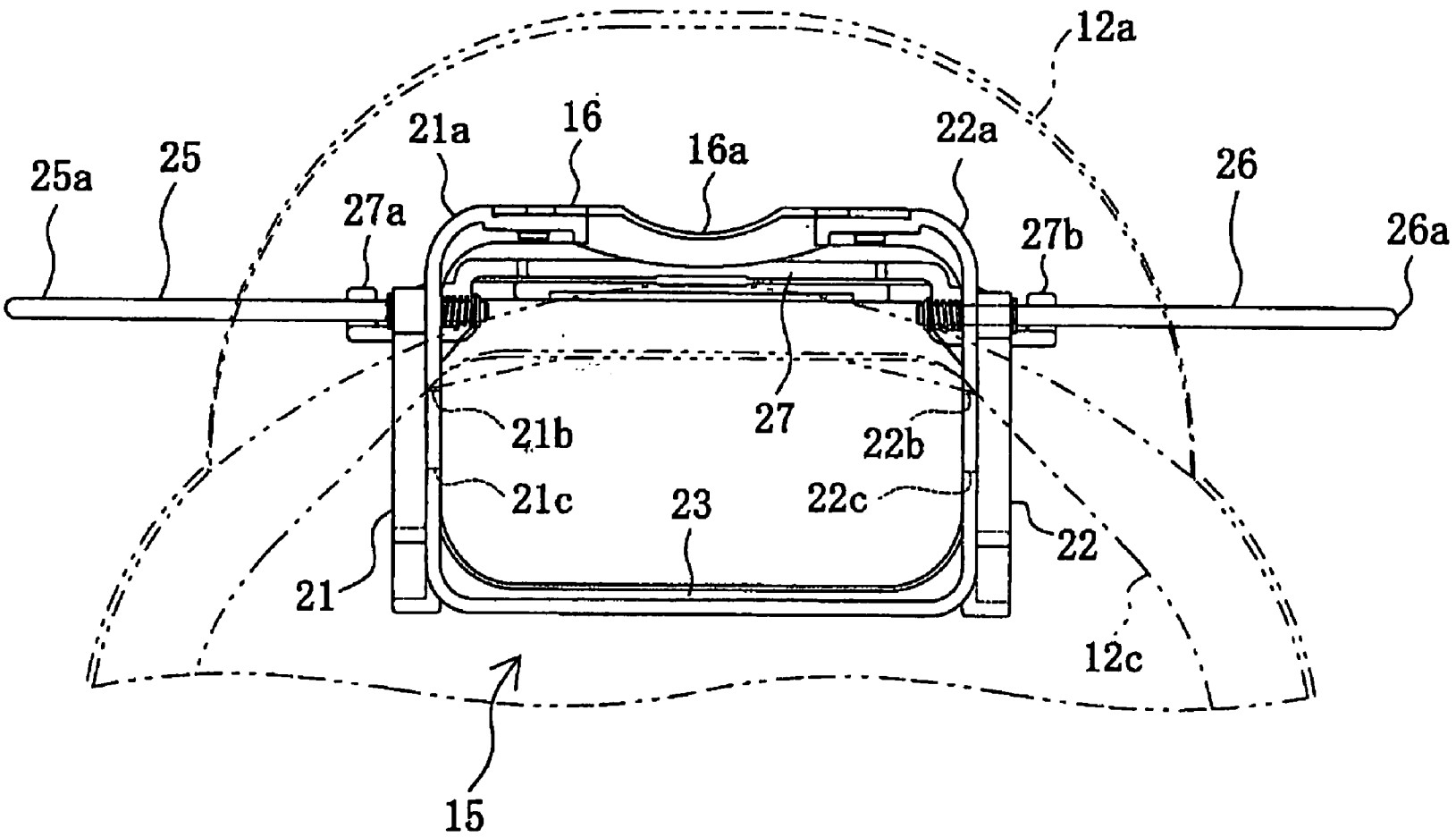
FIG. 11 is a rear view of the embroidery frame as viewed at the proximal end side of the embroidery frame.

The embroidery frame 15 operates as follows. Firstly, the user places the embroidery frame 15 on the table 10 and loosens the set screw 35 to spread the split pressing members 28 and 29 rightward and leftward respectively. The user then causes the cap pressing frame 18 to pivot upward about the pivot shafts 25*c* and 26*c* thereby to release the cap pressing frame 18 from the body support 20 as shown by the two-dot chain line in FIG. 5. In this state, the visor 12*a* is received by the visor supports 21*a* and 22*a*, and the perspiration inducer 12*c* is turned over to the visor 12*a* side and then caught by the perspiration inducer engagement portions 21*c* and 22*c*. Further, both sides of the visor 12*a* are abutted against the visor escapes 21*b* and 22*b* respectively (see FIG. 11).

In this state, both sides of the visor 12*a* abut against the visor escapes 21*b* and 22*b* which is located lower by one step, and the lower portion of the visor 12*a* is supported by the paired visor receivers 21*a* and 22*a* and visor support 16*a*. As a result, the visor 12*a* is held in an inclined state, whereupon the embroidery-forming portion 12*d* of the cap body 12*b* corresponds to the upper side of the sewing opening 20*a*.

Thus, the lower part of the visor 12*a* is received by the visor receivers 21*a* and 22*a* at a location higher by one step than the body support 20. Moreover, the central portion of the visor 12*a* is supported by the visor support 16*a*, and both sides of the inclined visor 12*a* abut the visor escapes 21*b* and 22*b* formed by cutting off the side walls 21 and 22 so as to assume lower positions respectively. Consequently, the visor 12*a* can be held in the inclined state three-dimensionally in the same manner as embroidery frame dedicated to caps and accordingly, the embroidery-forming portion 12*d* can easily be stretched flat.

In this state, the cap pressing frame 18 is pivotally lowered. The engagement frames 25*b* and 26*b* are spread outward when the proximal end sides of the engagement frames 25*b* and 26*b* engage the rear ends of the protruding bars 20*f* and 20*g* during the lowering of the frame 18 respectively. In this case, as shown in FIG. 3, the holding levers 25 and 26 are moved outward against the spring force of the compression coil spring 32, and the pivot shafts 25*c* and 26*c* are inclined by the tapered bearing holes 21*f* and 22*f* such that the engagement frames 25*b* and 26*b* are moved outward via the elongate recesses 27*c* and 27*d* of the pressing member 27. Accordingly, since the holding levers 25 and 26 are allowed to be spread outward with the pivot supports 21*d* and 22*d* serving as fulcrums respectively, the engagement frames 25*b* and 26*b* can easily get over the protruding bars 20*f* and 20*g* and protrusions 20*h* and 20*i*.

Thus, when the engagement frames 25*b* and 26*b* have gotten over the protruding bars 20*f* and 20*g* and protrusions 20*h* and 20*i*, the holding levers 25 and 26 are biased widthwise inward by the spring force of the compression coil spring 32, so that the cap body 12*b* is held between the holding levers 25 and 26 and the protruding bars 20*f* and 20*g*. Furthermore, the pressing member 27 presses the rear end side of the embroidery-forming portion 12*d* (see FIG. 9) against rear transverse support 20*d* by the biasing force of the torsion coil springs 33 and 34. In this state, the user slightly tightens the set screw 35 and then forcibly pulls the cap body 12*b* located around the body support 20 with both hands so that the embroidery-forming portion 12*d* is stretched flat.

In this case, the cap body is easy to pull since the body support 20 is located higher by the height of the side walls 21 and 22 than the table 10. The engagement frames 25*b* and 26*b* are locked by the protrusions 20*h* and 20*i*. Accordingly, even when the cap body 12*b* is pulled, the holding levers 25 and 26 are prevented from getting over the protruding bars 20*f* and 20*g* respectively.

Figure 8:
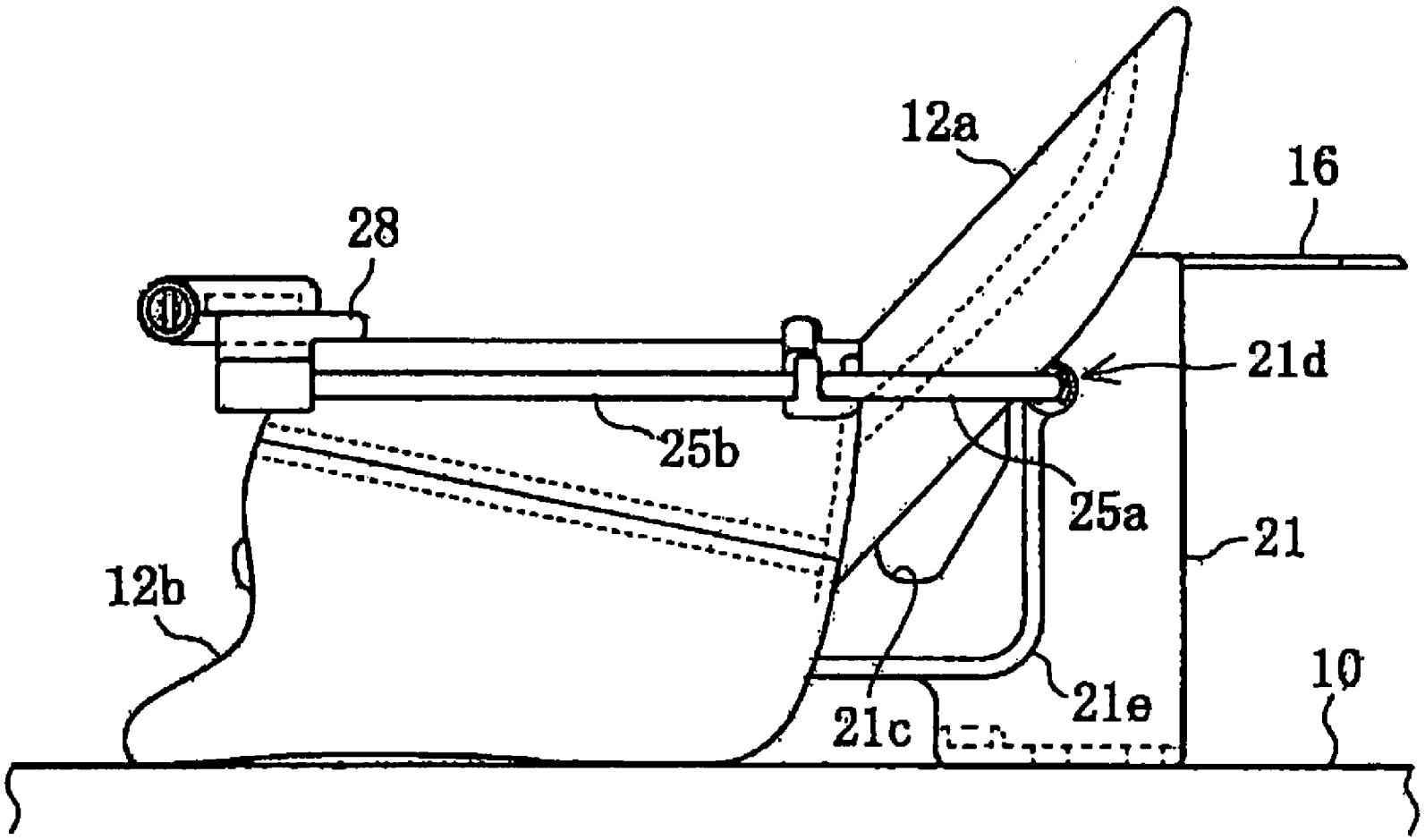
FIG. 8 is a view similar to FIG. 5, showing a cap attached to the embroidery frame.
Figure 9:
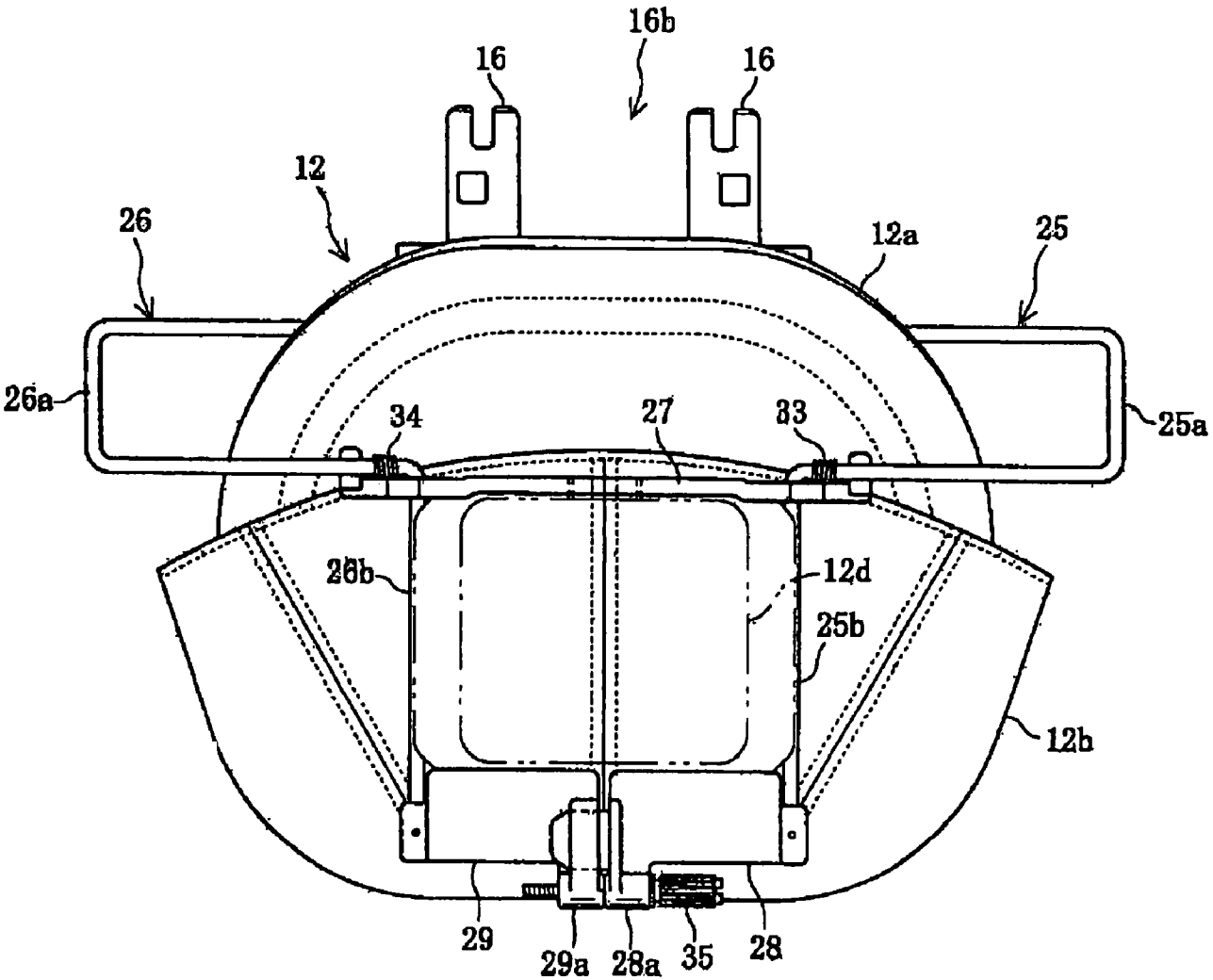
FIG. 9 is a view similar to FIG. 3, showing a cap attached to the embroidery frame.
Figure 10:
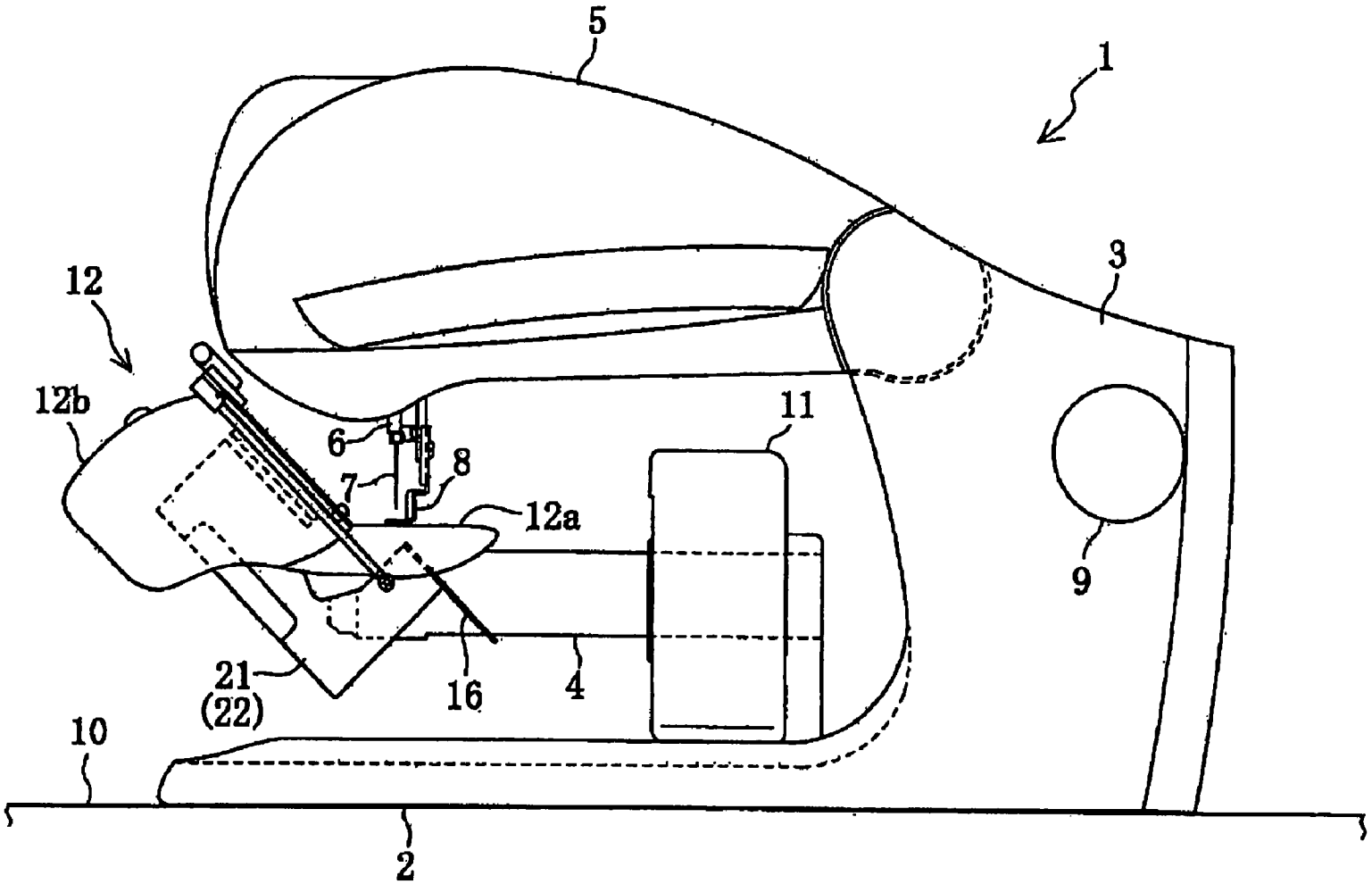
FIG. 10 is a view similar to FIG. 1, showing the condition where an embroidery frame is being attached to the sewing machine.

Thus, after the embroidery-forming portion 12*d* has been stretched flat, the set screw 35 is tightly fastened finally. Consequently, the embroidery-forming portion 12*d* of the cap body 12*b* can be clamped in the stretched state by the protruding bars 20*f* and 20*g* and the cap pressing frame 18, as shown in FIGS. 8 and 9. In other words, the cap 12 can be held by the cap pressing frame 18 so as to be fitted with the cap support 17, whereupon the cap 12 can easily be attached to the embroidery frame 15.

Furthermore, the cap body can be supported by a rectangular frame including the paired longitudinal supports 20*b* and 20*c* and the paired transverse supports 20*d* and 20*e*. Moreover, an embroidering operation can be carried out in the sewing opening 20*a* defined inside the rectangular frame.

The paired side walls 21 and 22 are connected to each other in an opposed state and can be held in the connected state by the connecting member 23. Consequently, the height of the body support 20 can reliably be maintained.

When the cap 12 is attached to the embroidery frame 15, the paired holding levers 25 and 26 are caused to pivot upward to be opened and thereafter lowered, the cap body 12*b* can be pressed against the transverse support 20*e* by the pressing member 27. The cap body 12*b* can further be pressed against the distal end side transverse support 20*e* by the paired split pressing members 28 and 29. Finally, the opposite ends of the paired split pressing members 28 and 29 can be fastened tightly by the set screw 35.

When held by the body support 20, the cap body 12*b* can reliably be engaged with the protruding bars 20*f* and 20*g* via the engagement frames 25*b* and 26*b* of the holding levers 25 and 26 respectively. Consequently, the function of holding the cap 12 can be exhibited sufficiently.

The visor 12*a* can be detoured by the detouring portions 25*a* and 26*a* regardless of the size thereof, and the cap body 12*b* can be attached to the cap support 17 by the engagement frames 25*b* and 26*b* so as to be fitted with the cap support 17.

When the engagement frames 25*b* and 26*b* are caused to get over and then engage the protruding bars 20*f* and 20*g* and protrusions 20*h* and 20*i*, the engagement frames 25*b* and 26*b* can be moved widthwise outside with respect to the embroidery frame 15 against the biasing force of the compression coil spring 32. Moreover, when the engagement frames 25*b* and 26*b* have gotten over the protruding bars 20*f* and 20*g* and protrusions 20*h* and 20*i*, the engagement frames 25*b* and 26*b* can reliably be engaged with the protruding bars 20*f* and 20*g* by the biasing force of the compression coil spring 32.

As shown in FIG. 7, when the engagement frames 25*b* and 26*b* are caused to get over and then engage the protruding bars 20*f* and 20*g* and protrusions 20*h* and 20*i*, the portions of the holding levers 25 and 26 located at the sides of the split pressing members 28 and 29 can be opened via the tapered bearing holes 21*f* and 22*f* formed in the pivot supports 21*d* and 22*d* to a large extent with pivot shafts 25*c* and 26*c* serving as fulcrums widthwise outward with respect to the embroidery frame 15. Consequently, the engagement frames 25*b* and 26*b* can easily be engaged with the protruding bars 20*f* and 20*g* and protrusions 20*h* and 20*i*.

Next, the following describes a case where the embroidery frame 15 is attached to the embroidery sewing machine 1. The user holds the embroidery frame 15 in an inclined state so that the paired driving connectors 16 are positioned at both sides of the cylinder bed 4 and so that the visor 12*a* becomes horizontal. In this case, the user can move the embroidery frame 15 vertically via the attachment opening 16*b* formed between the driving connectors 16. Accordingly, the driving connectors 16 and embroidery frame 15 can be prevented from interference with the cylinder bed 4, sewing needle 7 and presser foot 8.

The user then detours the needle 7 and presser foot 8 while moving the inclined embroidery frame 15 inward. The user then changes the embroidery frame 15 to a horizontal state and connects the driving connectors 16 to the corresponding drivers 11 of the embroidery frame driving mechanism as shown in FIG. 1. Subsequently, embroidery is sewn on the embroidery-forming portion on the basis of a previously selected embroidery pattern. In this case, the perspiration inducer 12*c* of the cap 12 is engaged with the perspiration inducer engagement portions 21*c* and 22*c* so as to be spaced away from the sewing opening 20*a*. Consequently, the perspiration inducer 12*c* can reliably be prevented from being embroidered.

The above-described embroidery frame 15 for caps includes the cap support 17 having the sewing opening 20*a* defining the embroidable region and the body support 20 supporting the cap body 12*b* around the sewing opening 20*a*. The embroidery frame 15 further includes the cap pressing frame 18 fitted with the cap support 17 so as to come into contact with and depart from the cap support. The cap pressing frame 18 presses, against the body support 20, the cap 12 attached to the cap support 20 fitted with the cap support 17. The cap support 17 includes the paired side walls 21 and 22 which are capable of being disposed at both sides of the cylinder bed 4 and each of which has the predetermined height. The cap support 17 further includes the paired visor supports 21*a* and 22*a* which are provided on the upper ends of the proximal ends of the side walls 21 and 22 respectively and which receive a visor of the cap from below at a position located higher by a predetermined height than the body support 20. The cap support 17 still further includes the paired visor escapes 21*b* and 22*b* provided on the side walls 21 and 22 for escaping the visor 12*a* of the cap 12 respectively. The visor escapes 21*b* and 22*b* are formed by cutting off the upper ends of the side walls 21 and 22 respectively. When the cap 12 with the visor 12*a* is to be set on the embroidery frame 15 so that embroidery can be sewn on the cap 12, the visor 12*a* is received at the position located higher by a predetermined height than the body support 20. Moreover, the visor 12*a* is escaped by the visor escapes 21*b* and 22*b* formed by cutting off the upper ends of the side walls 21 and 22 respectively. As a result, the visor 12*a* can be held in the inclined state three-dimensionally, whereupon the embroidery-forming portion 12*d* of the cap body 12*b* can be easy to stretch flat relative to the body support 20 of the cap support 17.

Moreover, since the body support 20 is located higher by the height of the side walls 21 and 22, the user can pull the cap body 12*b* located around the body support 20 with both hands so that the embroidery-forming portion 12*d* is stretched flat. As a result, the working efficiency can be improved in stretching the cap body 12*b*. Further, since the embroidery frame 15 has only the cap support 17 and cap pressing frame 18, the size and weight of the embroidery frame 15 can be reduced, and accordingly, the cost of the embroidery frame 15 can also be reduced.

Furthermore, the embroidery frame 15 includes the cap support 17 having the sewing opening 20*a* and the body support 18 and the paired driving connectors 16. The driving connectors 16 are each formed so as to extend by a predetermined length in such a direction that the driving connectors 16 depart from the sewing opening 20*a*. Further, the attachment opening 16*b* is defined between the driving connectors 16 so that the attachment opening 16*b* allows the visor 12*a* of the cap 12 held on the embroidery frame 15 to escape from the sewing mechanism when the driving connectors 16 are attached to the driver 11 of the embroidery frame driving mechanism. Accordingly, when the embroidery frame 15 holding the cap 12 is attached to the sewing machine 1, the driving connectors 16 extending to the proximal end side of the embroidery frame 15 are disposed at both sides of the cylinder bed 4 respectively. In this state, the embroidery frame 15 can easily be caused to escape so that the visor 12*a* is allowed to pass through gaps defined by a sewing needle 7 and presser foot 8 while being moved vertically without being rotated right-and-left. Consequently, the driving connectors 16 can easily be connected to the driver 11 of the embroidery frame driving mechanism.

Furthermore, when the embroidery frame 15 holding the cap 12 is to be attached to the sewing machine, the embroidery frame 15 can be moved vertically via the attachment opening 16*b* without interference of the driving connectors 16 with the cylinder bed 4 according to a degree of inclination of the visor 12*a* relative to the cap body 12*b*.

The paired driving connectors 16 are integrally connected by the visor support 16*a* thereby to be held with a predetermined space therebetween. Moreover, when the cap 12 has been attached to the embroidery frame 15, the central part of the visor 12*a* can be supported in an inclined state from below while the inclination of the visor 12*a* relative to the cap body 12*b* is maintained.

The invention should not be limited to the foregoing embodiment described above with reference to the accompanying drawings. The embodiment can be modified and expanded as follows. The paired holding levers 25 and 26 may be bent downward immediately outside the connections 25*d* and 26*d* and further bent toward the side walls 21 and 22 so as to be pivotally mounted on the side walls 21 and 22, respectively. In this case, the detouring portions 25*a* and 26*a* of the holding levers 25 and 26 can be rendered smaller in size.

The perspiration inducer engagement portions 21*c* and 22*c* may have the same height as the visor escapes 21*b* and 22*b*.

The holding levers 25 and 26 and the pressing member 27 may be thickened according to a thickness, hardness and size of the cloth of the cap 12. Thus, the embroidery frame 15 to be prepared may match the cloth of the cap 12.

Although the sewing opening 20*a* is rectangular in the foregoing embodiment, the sewing opening 20*a* may be trapezoidal in shape and have a transverse support 20*d* shorter than the transverse support 20*e*. Further, the sewing opening 20*a* may be elliptic.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. An embroidery frame for a cap having a proximal end side provided with a pair of driving connectors detachably connected to a driver of an embroidery frame driving mechanism of a sewing machine including a cylinder bed, the embroidery frame comprising:

a cap support having a pair of side walls capable of being disposed at both sides of the cylinder bed so that the side wall are parallel to a direction of extension of the cylinder bed, each side wall having an upper end, a proximal end and a predetermined height;

a body support provided on the upper ends of the side walls for supporting a cap body of a cap on which embroidery is to be sewn, the body support forming a sewing opening defining an embroidable region, the side walls including:

a pair of visor supports provided on upper ends of the proximal ends of the side walls respectively, the visor supports receiving a visor of the cap from below at a position located higher by a predetermined height than the body support; and a pair of visor escapes provided on the side walls for escaping the visor of the cap respectively, the visor escapes being formed by cutting off the upper ends of the side walls respectively; and a cap pressing frame provided so as to come into contact with and depart from the cap support, the cap pressing frame pressing, against the body support, the cap attached to the cap support so as to be fitted with the cap support.

2. The embroidery frame according to claim 1, wherein the body support includes a pair of longitudinal supports formed on the upper ends of the side walls so as to be parallel to the side walls respectively and a pair of transverse supports perpendicular to the longitudinal supports, wherein the embroidery opening is defined into a rectangular shape by the longitudinal and transverse supports.

3. The embroidery frame according to claim 1, wherein the side walls have lower ends of the proximal ends thereof connected to each other by a connecting member, respectively.

4. The embroidery frame according to claim 1, wherein the side walls include respective perspiration inducer engagement portions engaging a perspiration inducer of the cap, the perspiration inducer engagement portions being continuous to the visor escapes respectively.

5. The embroidery frame according to claim 2, further comprising a pair of engagement protruding bars provided near the longitudinal supports so that the cap pressing frame engages the engagement protruding bars with a cap body being sandwiched between the cap pressing frame and the engagement protrusions, respectively, wherein each engagement protruding bar includes a part provided with a protrusion engaging and locking the cap pressing frame form above.

6. The embroidery frame according to claim 1, wherein the cap pressing frame includes a pair of holding levers mounted on the side walls so as to pivot about an axis perpendicular to the side walls respectively, a pressing member provided between the holding levers so as to press the cap body against the transverse support at the proximal end side, a pair of split pressing members provided on distal ends of the holding levers at the distal end side respectively and fastening portions provided on the split pressing members so as to be capable of fastening opposite ends of the split pressing members.

7. The embroidery frame according to claim 6, wherein the holding levers have engagement frames engageable with the protruding bars respectively.

8. The embroidery frame according to claim 6, wherein the holding levers have detouring portions which detour the visor of the cap outward.

9. The embroidery frame according to claim 6, wherein the holding levers have pivot shafts pivotally supported on the side walls respectively, the side walls are formed with pivotally supporting portions supporting the pivot shafts so that the pivot shafts pivot about central axes respectively and biasing members elastically biasing the pivot shafts toward a widthwise central side of the cap support.

10. The embroidery frame according to claim 9, wherein the pivotally supporting portions are formed with respective tapered bearings supporting the pivot shafts so that the pivot shafts are swingable in a direction perpendicular to a direction of the central axis and parallel to the direction of extension of the cylinder bed.

11. The embroidery frame according to claim 1, wherein the driving connectors include respective visor supports supporting the visor of the cap, the driving connectors being integrally connected by the visor supports, and each visor support has an inclined shape conforming to an inclination of the visor of the cap.

12. An embroidery frame for a cap for holding the cap to be embroidered so that embroidery is allowed to be sewn on the cap, the embroidery frame being attached to a sewing machine in use, the sewing machine including a cylinder bed, an embroidery frame driving mechanism including a driver and a sewing mechanism, the embroidery frame comprising:

a cap support including a body support supporting a body of the cap, the body support forming a sewing opening defining a plane embroidable region parallel to an upper surface of the cylinder bed, the cap support having a proximal end; and a pair of driving connectors provided at the proximal end side of the cap support and detachably connected to the driver of the embroidery frame driving mechanism of the sewing machine, the driving connectors being spaced away from each other so that a space larger than a width of the cylinder bed with respect to a horizontal direction, the driving connectors being formed so as to extend by a predetermined length in such a direction that the driving connectors depart from the sewing opening, the driving connectors defining an attachment opening therebetween so that the attachment opening allows a visor of the cap to detour the sewing mechanism when the driving connectors are attached to the driver of the embroidery frame driving mechanism.

13. The embroidery frame according to claim 12, wherein the attachment opening has a predetermined length in a direction of extension of the cylinder bed and a predetermined width in a direction perpendicular to the direction of extension of the cylinder bed.

14. The embroidery frame according to claim 12, wherein the driving connectors include respective visor supports supporting the visor of the cap, the driving connectors being integrally connected by the visor supports, and each visor support has an inclined shape conforming to an inclination of the visor of the cap.

* * * * *